United States Patent [19]

Roberson

[11] 4,275,483

[45] Jun. 30, 1981

[54] CONTROL APPARATUS FOR A CARDING MACHINE

[76] Inventor: James H. Roberson, Rte. 6, 203 Ashwood Ave., Greenville, S.C. 29607

[21] Appl. No.: 100,640

[22] Filed: Dec. 5, 1979

[51] Int. Cl.[3] ..... D01H 5/32; D01H 5/38

[52] U.S. Cl. ..... 19/240

[58] Field of Search ..... 19/0.23, 105, 106 R, 19/240, 145.7

[56] References Cited

U.S. PATENT DOCUMENTS

| | | | |
|---|---|---|---|
| 3,109,204 | 11/1963 | Linnert et al. | 19/241 |
| 3,157,915 | 11/1964 | Gilbo | 19/106 R |
| 3,231,940 | 2/1966 | Catling et al. | 19/240 X |
| 3,400,432 | 9/1968 | Long | 19/240 |
| 3,644,964 | 2/1972 | Varga | 19/240 |
| 3,680,192 | 8/1972 | Stevels | 19/240 |
| 3,709,406 | 1/1973 | Binder et al. | 19/240 X |
| 3,827,106 | 8/1974 | Varga | 19/240 |
| 3,852,848 | 12/1974 | Feller | 19/240 |
| 3,862,473 | 1/1975 | Feller | 19/240 |
| 3,889,319 | 6/1975 | Roberson | 19/240 X |
| 3,925,850 | 12/1975 | Lytton | 19/240 X |
| 4,137,487 | 1/1979 | Niestroj et al. | 19/240 X |
| 4,161,052 | 7/1979 | Erben | 19/240 |
| 4,184,361 | 1/1980 | Erben | 19/240 X |
| 4,199,843 | 4/1980 | Leifeld et al. | 19/240 |
| 4,199,844 | 4/1980 | Goetzinger | 19/240 |

*Primary Examiner*—Louis Rimrodt

*Attorney, Agent, or Firm*—Bailey, Dority & Flint

[57] ABSTRACT

An open loop control system is disclosed for controlling the production of a web or sliver on a carding machine so as to have a uniform weight per unit length. A novel sensing arrangement for the card input is disclosed wherein corrections to the input are made at the same mechanical plane and point in the feeding process as where the input is sensed to provide highly accurate control of the weight of the output.

22 Claims, 11 Drawing Figures

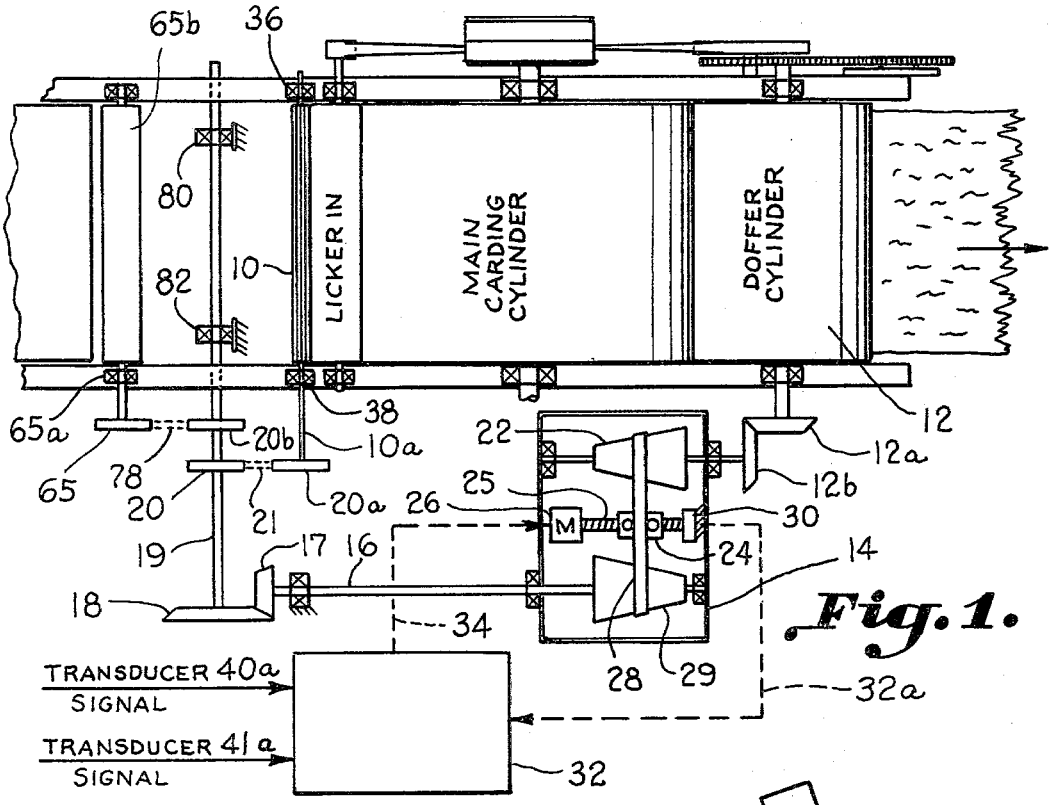
Fig. 1.
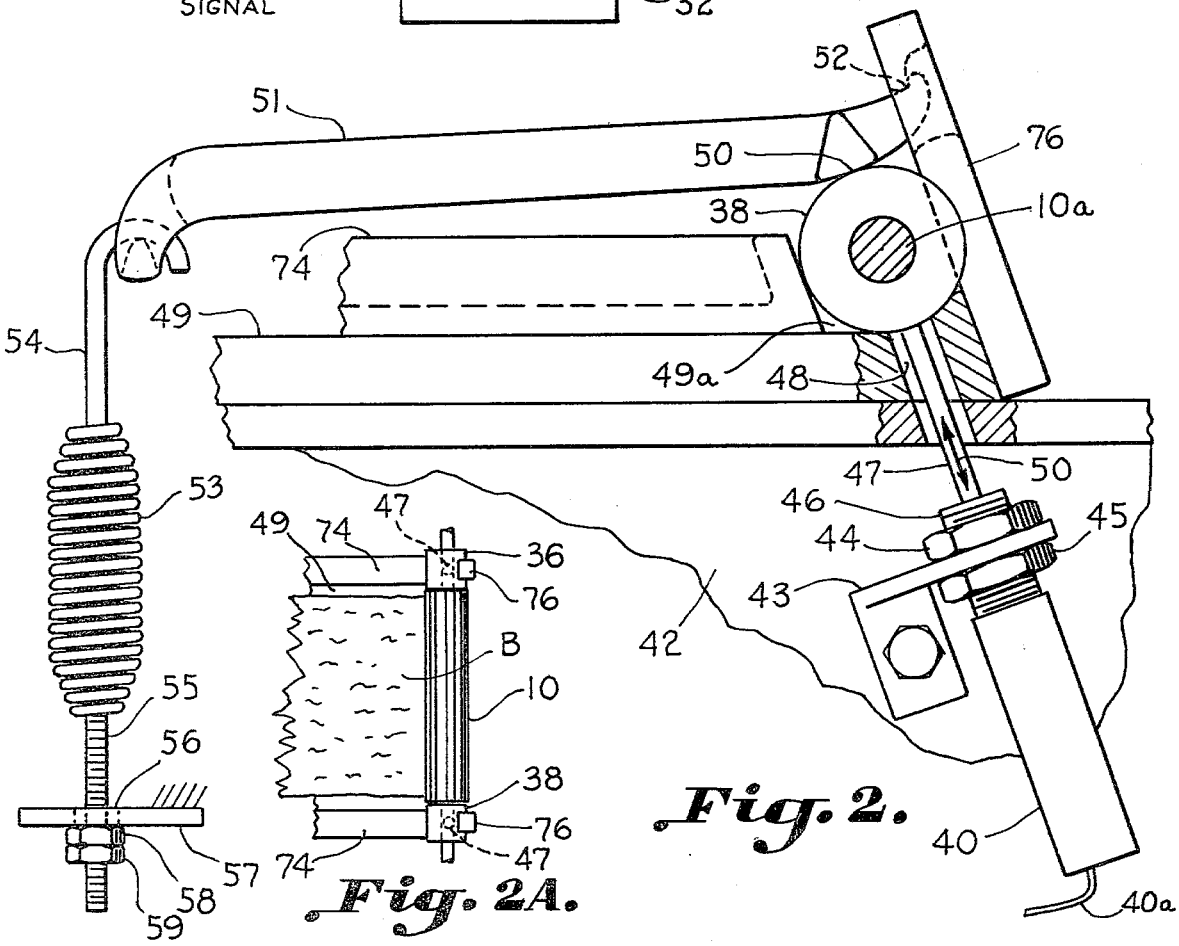
Fig. 2.
Fig. 2A.

CONTROL APPARATUS FOR A CARDING MACHINE

BACKGROUND OF THE INVENTION

In the conventional textile industry, card sliver is generally drawn and/or spun into a yarn which is subsequently formed into a fabric by either knitting or weaving.

In the non-woven textile industry, a plurality of carded webs are generally laminated and bonded together to form a fabric directly.

Since the uniformity of the fabric product is ultimately determined primarily by the uniformity of the carded web/sliver, it is highly desirable that their weight per unit length be exceedingly uniform. For most textile applications, the weight variation of every consecutive yard of web/sliver should not exceed about plus or minus 3 to 5 grains from the mean weight if a first class end product is to be achieved.

As a frame of reference, 3 to 5 grains correspond to about the weight of three United States postage stamps; each measuring about $\frac{7}{8} \times 1$ inch. To make weight measurements of this order of magnitude requires sensitive laboratory grade instruments which is usually difficult to accomplish accurately in a production environment because minor outside variables such as air currents from the air conditioning systems or persons breathing near the scales can affect the results.

Therefore, to achieve this desired degree of uniformity on a production basis with a continuously moving product using fibers which are highly variable in their processing characteristics and behavior and using massive machines whose members possess high inertia is a problem to which considerable attention need be given. Many attempts by the prior art have been made to achieve this important, but elusive objective.

With a carding machine in good mechanical condition, there are fundamentally two factors which govern the instantaneous web weight delivered by it: the relative speed of the card feed roll with respect to the doffer cylinder, and the instantaneous batt or lap density entering the machine at the feed roll.

To maintain a constant and uniform card output weight, prior systems have attempted to either (a) monitor some characteristic of the web/sliver delivered, taken to represent weight, and vary the speed of the card's feed roll as required to hold this characteristic constant (hereinafter called, "After-Card Regulators"), or (b) to monitor some characteristic of the batt or lap, taken to represent density, and adjust some weight control mechanism in order to hold that characteristic constant (hereinafter called, "Before-Card Regulators").

After-Card regulators, by their very nature, are "closed loop" control systems in that they monitor downstream of the correction point and feedback a signal to adjust the speed of the corrector. Examples of these type systems are shown typically in U.S. Pat. Nos. 3,925,850, 3,157,915; 3,644,964; 3,852,848; 3,862,437, and 3,827,106.

It is well known that "closed loop" control systems usually require either wide dead bands or some form of dampening in order to remain stable. Otherwise, they will begin "feeding" off their own corrective signals and go into oscillation. A general rule of thumb is that, for most systems, the amount of delay should equal about 4 to 6 times the "time effective distance" between sensor and corrector.

In a card, this is not sufficient because the machine has a large capacity to store and release fibers within the carding points of the wire wrapped around the various cylinders. Because of the long distance between sensor and corrector, and the high amount of dampening needed to accommodate the system's "springiness" due to fiber storage, the "minimum effective correction length" of the art cited supra is somewhere on the order of 35 to 50 yards of web or sliver.

This is quite long for most textile applications because just one yard of card sliver appears in many thousands of yards of yarn. Devices of this type are capable of controlling long term weight "drifts" but because they have a tendency to oscillate or "hunt", they also generate "short term" variation which is deleterious to the quality of the yarn. Because these systems tend to create rather than eliminate short term weight variations, they are unsuitable to meet the objects of instant invention.

Prior art "Before-Card" regulators fall into two classes: card mounted batt formers and lap forming picker eveners ("scutchers").

The Chute Feeds taught by U.S. Pat. Nos. 3,709,406 and 3,889,319 are also "closed loop" systems in that they sense downstream of the correcting mechanism and feed back the control signal. Both are set point controllers.

U.S. Pat. No. 3,709,406 measures the thickness of the batt and varies the air pressure atop the stock column to attempt to hold the thickness constant. Obviously, this system requires a very slow response rate, or high degree of dampening to prevent the over-compaction of an entire chute full of fibers. This would result in hundreds of yards of "off weight" sliver and many, many thousands of yards of "off weight" yarn because compacted textile fibers do not have the capacity for total springback or recovery following the reduction or removal of a compaction load.

The chute feed of U.S. Pat. No. 3,889,319 reduces this weakness by employing a pair of "stuffing rolls" immediately up stream of the thickness sensing rolls. The stuffing rolls vary the number of fibers fed into the cavity (defined by the two pairs of rolls) as required to maintain a constant gap in the nip of the thickness sensing rolls. Using conventional diameter rolls, the distance from the nip of the sensing rolls to the nip of the correcting rolls is on the order of about 3 inches. Applying the closed loop "dampening rule" of 4 to 6 times delay means the "minimum corrective length" must be at least 12 inches of batt to remain stable. With conventional carding engine drafts, each inch of batt translates into about 2 to 3 yards of web/sliver which means the minimum corrective length in web/sliver is on the order of 25 to 35 yards.

These set point systems are suitable for controlling long term weight drifts but cause short term errors due to "hunting", and therefore, do not meet the objects of instant invention.

The well known "picker evener" illustrated typically by U.S. Pat. Nos. 3,400,432; 3,680,192; 3,109,204 and 3,231,940 represent a second form of "Before-Card" regulators. In these systems, a plurality of sensing plates or pedals are disposed along a feed regulating roll having a fixed axis of rotation. The pedals are mechanically linked with weights and levers or springs to integrate the displacement of each, and the resulting average displacement is applied directly to a speed variator to adjust the speed of the feed regulating roll.

Being an "open loop" system, the "picker evener" does not require dampening for stability and can respond fairly quickly to correct for short term errors.

Numerous attempts have been made to adapt the "picker evener" to carding engine applications without success because the characteristics of the batts measured and corrected by pickers is different from the batts or laps commonly fed conventional carding engines.

A picker usually produces enough laps to feed 6 to 12 cards and normally operates with production rates between 400 to 800 pounds per hour. The batt passing through its thickness sensing elements oftentimes has a weight on the order of 50 to 100 ounces per square yard or more.

Conversely, a conventional card usually operates at between 30 to 150 pounds per hour and experience has shown that the best carding quality is obtained when the batt or lap entering the card weighs on the order of 12 to 30 ounces per square yard.

As discussed in greater detail, infra, it is not practical to get a reliable, sensible control signal suitable for operating an open-loop control system over a wide range when conventional "picker evener" systems are applied to conventional cards because the reduced batt bulk is incapable of overcoming the frictional forces, lost motions, and minute structural member deflections characteristic of state of the art sensing mechanisms.

U.S. Pat. No. 2,725,599 teaches the application of a "picker evener" to a carding engine. Assuming this device works in practice, its success is undoubtedly attributable to the multiple laminations of the lap shown in the patent. By using multiple plys of lap, this device, in effect, reconstructs a thicker product for sensing and control. However, it is well known in the art that cross laid laps inherently contain a large amount of inch to inch, or short term variation due to the ridges and discontinuities caused by the criss cross patterns.

For the above reasons and others which will be apparent hereinafter, none of the prior art systems are suitable to meet the high standards of weight control which are the objects of the present invention.

SUMMARY OF THE INVENTION

It has been found that accurate control of the unit weight of a carded web of instant invention may be had by utilizing an open loop control system wherein the feed roll is utilized both as a stock thickness sensor and as a variable speed flow regulator, and is driven in basic speed synchronization with the doffer roll while modifying this basic speed so that the mass per unit length delivered from the machine remains contant irrespective of variations in the number of fibers present at the feed roll or variations in speed of the doffer roll.

This invention has particular importance in sensing and correcting thin, single thickness, lightweight batts such as weighing less than 50 ounces per square yard.

Accordingly, an important object of the present invention is to provide improved feeding and control apparatus for conventional textile carding machines, which eliminates both short term and long term weight variations, so that each individual yard of web produced is exceedingly uniform.

Another object of the present invention is to provide sensing apparatus which is capable of accurately measuring the thickness of single thickness laps or thin batts which weight less than the batts traditionally fed to lap forming pickers, and which produce a control signal with sufficient magnitude and linearity that the control signal is suitable to operate an open loop control system.

Another important object of the present invention is to provide a simple universal system which can obviate the need for the "picker process" because it is suitable for either conventional or non-woven applications due to its superior control characteristics and its optimum location in the overall scheme of fiber flow.

Still another important object of the present invention is to provide card feed control apparatus capable of producing a carded sliver with sufficient short term weight uniformity that some, or all, of the traditional subsequent drawing processes may be eliminated, if desired, without degrading the quality of yarn below existing standards.

Yet another important object of the present invention is to provide improved feed control apparatus which produces a superior carded product containing fewer neps for a given net carding rate or an equal number of neps for a higher net carding rate.

Yet another important object of the present invention is to utilize a card feed roll under certain optimum biasing loads to perform its traditional feeding functions while also utilizing the feed roll as a displacement sensing member to provide a reliable control signal to operate an open loop control system.

Still another important object of the present invention is to provide a means for driving the card's feed roll(s) so that the reaction forces of the driving members operate in such a vectorial direction and magnitude that their effects on the ability of the feed roll(s) to accurately measure the number of fibers present at the point of sensing is minimized.

Still another very important object of the present invention is to provide a means of varying the speed of the flow regulating roll by controlling its driving energy from an external source by methods which do not needlessly diminish the potential energy level of the measured batt (stored in the compressed fibers as minute springs) so that the system can both accurately measure thinner batts and has a faster rate of response to weight errors than heretofore possible.

BRIEF DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein:

FIG. 1 is a schematic plan view illustrating control apparatus for controlling the production of a web or sliver on a carding machine to produce a uniform weight per unit length;

FIG. 2 is an enlarged elevation partially cut-away view illustrating bearing and transducer apparatus for sensing the displacement of a feed roll according to the invention;

FIG. 2*a* is a partial schematic plan view of the apparatus of FIG. 2;

DESCRIPTION OF A PREFERRED EMBODIMENT

Figure 3:
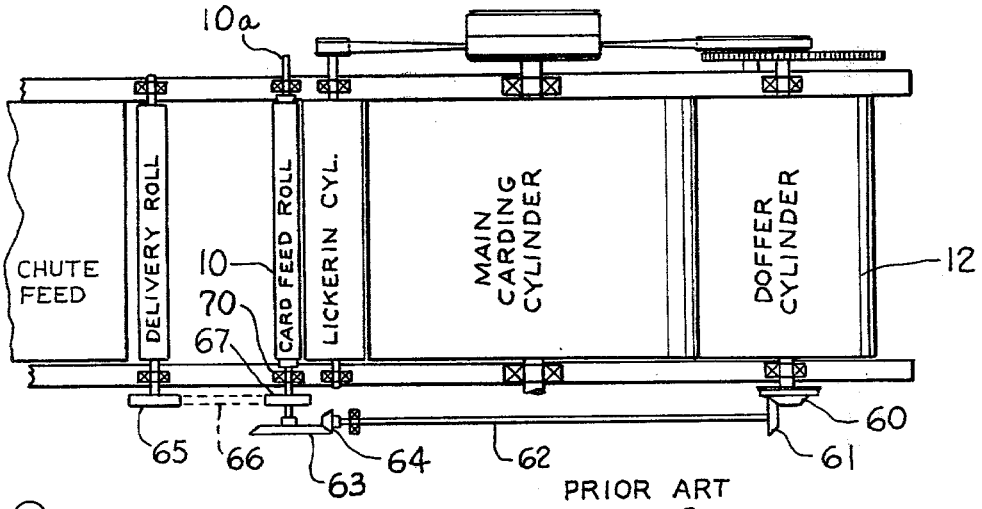
PRIOR ART Fig. 3.
FIGS. 3, 4, and 5 are schematic views of prior art drive and bearing arrangements for carding machines.

The present invention relates to the control of a conventional carding machine or engine and since such are well known in the art, only so much of a carding machine as is necessary to an understanding of the invention is illustrated. The details of a conventional carding machine may, for example, be had by reference to a standard Saco-Lowell card manufactured by the Saco-Lowell Manufacturing Company of Greenville, South Carolina.

Referring now to FIG. 1 of the drawings, there is shown a plan view schematic of the present invention applied to such a conventional carding engine. In this instance, the input roll is the card feed roll 10 and the output roll is the doffer cylinder 12. The card further typically includes a main carding cylinder and a licker-in cylinder which separates fibers fed from feed roll 10 prior to delivery to the main carding cylinder. The licker-in and doffer cylinders are driven by the main driving motion taken off the main carding cylinder which is typically rotated by an electric motor through a conventional belt and pulley drive arrangement as shown.

The fundamental or basic operation speed of input roll 10 is provided by driving a speed variator shown generally as 14 from the output roll 12 via bevel gears **12*a* and 12*b*. The output speed of the speed variator 14 is transmitted to drive input roll 10 via a drive train means comprised of side shaft 16 which turns a draft gear 17, which rotates plate gear 18 and jack shaft 19 which drives an intermediate drive means which includes a large sprocket 20 drivingly connected to a large sprocket 20*a* via a chain 21. Sprocket 20*a* is affixed to a drive shaft 10*a* of feed roll 10 for rotation thereof. With the drive arrangement just described, the speed of input roll 10 will instantly follow any changes in the speed of output roll 12** in a perfectly synchronized linear manner.

Speed variator 14 is shown as a cone drive type for illustration purposes only. Those skilled in the arts will immediately recognize that numerous other types exist and how to substitute them; e.g. variable speed electric or fluid driven motors.

To compensate for the continually varying number of fibers instantaneously present at the sensing or input roll 10, the basic speed input to an input cone 22 is modified by driving a belt shifter 24 (either right or left) by the rotation of a lead screw 25 via a bi-directional motor 26. As lead screw 25 traverses belt shifter 24 from side to side, drive belt 28 walks along the surfaces of the input cone 22 and output cone 29. The resulting changes in their diameters ratio causes the output speed of the side shaft 16 to vary accordingly.

In this manner, the input roll 10 is driven in basic speed synchronization with the output roll 12, and the basic speed is modified to compensate for the variation in the number of fibers present at input roll 10 in accordance with the present invention as will be hereinafter explained.

Although not shown, it is understood by those skilled in the art that the interior surface of belt shifter 24 contains threads which mate with the threads of lead screw 25. Likewise, not shown, are supporting bearings for lead screw 25, a step down gearing transmission interposed between the bi-directional motor 26 and lead screw 25 (which permits the motor to run at a high speed and low torque load while delivering a lower speed but higher torque capability to the lead screw) and inter-connecting gearing between the lead screw 25 and a position transducer 30. Whether or not one uses any of these items and how they are selected is simply a matter of designer's choice.

In the present invention, it is contemplated to use a single turn potentiometer (connected so that the center tap or wiper acts as a voltage divider) as position transducer 30. In this case, the gearing interposed between the lead screw 25 and the position transducer 30 is selected so that when the lead screw has rotated a sufficient number of turns to drive the belt shifter 24 from one end of the cones to the other, the shaft of the potentiometer will be rotated almost one turn.

The function of position transducer 30 is to provide intelligence to a programmable controller 32 along a feedback path **32*a* (shown dotted) to indicate the location of belt shifter 24** or the corresponding cones diameter ratio, at any given instant.

As will be described in greater detail below, programmable controller 32 takes the output from a pair of displacement transducers, averages them together and conditions this signel in a pre-programmed manner to provide a thickness reference voltage. The thickness reference voltage is then tested against the position or ratio feedback voltage via a null comparator network and this permits the programmable controller 32 to decide whether to drive the belt shifter 24 either left-stop-right. The drive signal flows along drive path 34 (shown dotted).

In a preferred embodiment, two displacement transducers are located beneath two floating bearings 36 and 38 which normally support feed roll shaft **10*a*. Referring now to FIG. 2 of the drawings, there is shown a method and apparatus for mounting such a displacement transducer 40 at one of the bearings 38 and of applying a biasing load to the input mounted roll 10: It being understood that a second transducer (41 (not shown) may be mounted in a like manner beneath bearing 36. The transducer 40 is fixed to the carding engine frame 42 by a bracket 43 and two jamming nuts 44 and 45 which are threaded onto the body of transducer 40 via a threaded portion 46. A spring loaded plunger 47 passes through a hole 48 drilled through conventional card feed plate 49 and the card frame 42 and rests against the bottom of the floating bearing 38 which supports the journaled shaft 10*a* of feed roll 10. The roller surface of feed roll 10 provides one nipping surface and feed plate 49 provides a fixed nipping surface defining a nip 49a** between which fibrous material B is nipped.

On the opposite end of plunger 47, a core (not shown) is affixed and free to float within the hollow body of transducer 40 which is preferably a linear variable differential transformer (LVDT) capable of accurately measuring displacements smaller than fractions of one thousandths of an inch. Movement of plunger 47 and its LVDT core is in the general direction indicated by arrow 50.

A biasing load to the fibers held between the input roll 10 and the feed plate 49 is applied to floating bearing 38 at loading point 50 by a lever 51 which has a fulcrum point 52 and is loaded at the other end by a spring 53 acting through a swivel hook 54.

The amount of tensioning load from spring 53 is readily adjustable via a threaded rod 55 passing through a hole 56 in a bracket 57 which is affixed to the frame 42 by any suitable means (not shown), adjusting nut 58, and jam nut 59 which prevents vibration from loosening the preset tension. An identical biasing arrangement (not shown) also exists on the opposite side of the card (FIG. 2*a*).

It has been found, according to the present invention, that a balance of forces need be continually maintained between the fibers under compression, the input roll 10, feed plate 49 and the biasing load system described above. If the biasing force exceeds the lifting capacity of the thousands of fibers acting in concert as tiny compression springs, the input roll 10 cannot be displaced to provide a measure of the number of fibers nipped therebetween. This is particularly true for lightweight batt measurement and control.

Likewise, importantly, care must be taken not only in the magnitude of biasing loads, but also in the manner in which the input roll 10 is rotatably driven. Otherwise, factors other than the number of fibers present will affect the displacement of the input roll 10 and thus interfere with the accuracy of the measurement.

Figure 4:
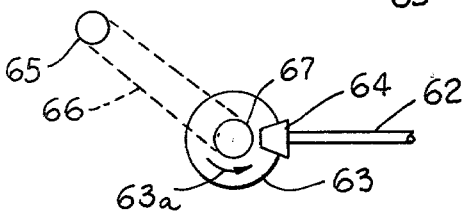
PRIOR ART Fig. 4.

FIGS. 3 and 4 illustrate a typical prior art drive arrangement wherein power to drive the input roll 10 is taken from the output roll 12 via bevel gears 60 and 61 which drive the side shaft 62, which turns the plate gear 63 via a meshing draft gear 64. An upstream load of a lap forming machine or chute feed may also be driven by delivery roll 10 with a sprocket 65 via a chain 66 which is driven by a sprocket 67 connected to the shaft of the feed roll 10. Often, the vibrating shaker plate of some chute feeds is also driven from the card feed roll 10.

Figure 5:
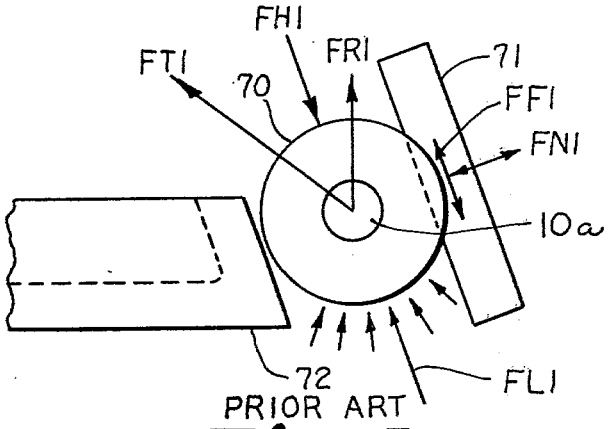
PRIOR ART Fig. 5.

Referring now to prior art FIGS. 3 through 5, it can be seen that torsional force to drive plate gear 63 in the direction of the arrow 63*a*, provided by the draft gear 64, results in a reaction force FR1 in a generally vertical direction. The tension force in chain 66 causes a reactive force on bearing 70 in the general direction shown as FT1. The biasing or hold down force FH1 applied to the bearing 70 operates in the direction as indicated by arrow FH1. The resultant lifting force FL1 of the fibers in compression acts on the feed roll 10 and is transmitted to the bearing 70 in the general direction shown.

Thus, the magnitude of the reactive force FR1 is determined by the loads required to drive both the card feed roll 10 and any upstream load. Components of the forces FR1 and FT1 (both highly variable) operate undesirably in the plane of sensing and measurement contemplated by the present invention.

Figure 6:
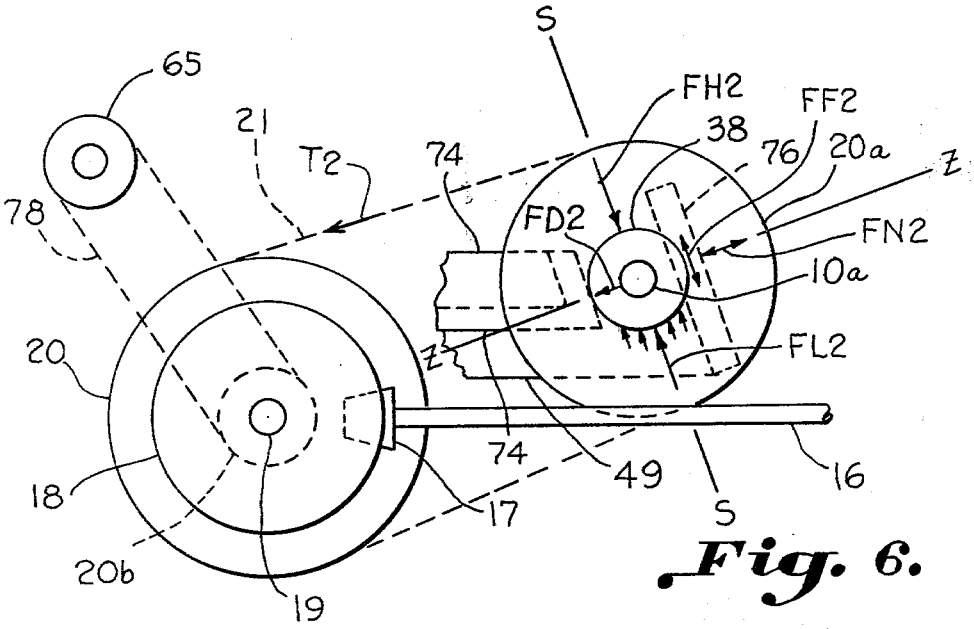
FIG. 6 is a schematic view illustrating forces encountered with transducer sensing apparatus according to the present invention.

In the present invention, the plane of sensing is shown by the line of displacement of the input roll, S—S, which in the embodiment of FIG. 2, runs approximately parallel with the bearing surfaces of conventional front bearing guide 74 and rear bearing guide 76 as illustrated in FIG. 6. Line of action Z—Z passes through the axis of the floating bearing 38 and the axis of jackshaft 19, and is substantially perpendicular to sensing plane S—S.

Thus, if drive sprockets 20*a* and 20 are selected with equal pitch diameters, the torsional load to drive the sensing input roll 10 will appear as a tension force in chain 21 on the tight side indicated by T2, and the resulting reaction force on the floating bearing 38 will be perpendicular to the plane of sensing S—S, as indicated by the drive force arrow FD2, shown on FIG. 6. The resultant lifting force of the fibers FL2 and the hold down or biasing force FH2 act opposite each other, in the plane of sensing S—S, and comprise the desired thickness sensing force balance network.

Thus, it can be seen that the only external variable force which can interfere with the sensing accuracy of the system is the frictional force FF2 (between floating bearing 38 and its respective guides 74 and 76) which is only a fractional part of the normal forces FN2 acting therebetween. The bulk of the normal forces FN2 result from the torsional drive force FD2 whose magnitude for a given drive load is inversely proportional the diameter of the sprocket 20*a*.

The reaction forces required to drive the upstream load via chain 78 and the reaction forces between draft gear 17 and plate gear 18 are referenced back to the card frame 42 via bearings 80 and 82 which support jackshaft 19.

Thus, it can be seen that the card feed roll can restrain the batt against the tearing actions of the licker-in cylinder with a lower magnitude of biasing force FH2 than required for biasing force FH1, because extra force to accommodate the variable aspects of the forces FR1 and FT1 is not needed. In practice, the instant invention has shown the ability to satisfactorily restrain certain commonly processed fibers against jerk-ins using surprisingly low biasing forces—equivalent to only 2 to 3 pounds per inch of batt width. The ability to operate with a lower biasing force level on the floating bearing 38 than used in conventional practice, offers important advantages over the prior art.

A lower level of FH2 causes a lesser amount of friction drag, as the fibers slide along the feed plate 49 which results in a lower required torsional drive force FD2 which results in a lower magnitude of bearing frictional force FF2 which is the principal potential cause of inaccuracy. With a lower force FH2, it is also possible to get initial displacement of floating bearing 38 with a thinner batt because FH2 is comprised of both the initial pre-load of the biasing system plus the additional biasing load caused by displacement of the biasing system. Clearly, the lower the required pre-load, the lower the number of fibers required to overcome it by compressive reaction to initiate displacement and, hence, to produce a sensible control signal to operate the system. The operating level of FH2 affects both the change in displacement for a given change in the number of fibers present and the linearity of the measurement displacement function.

Figure 7:
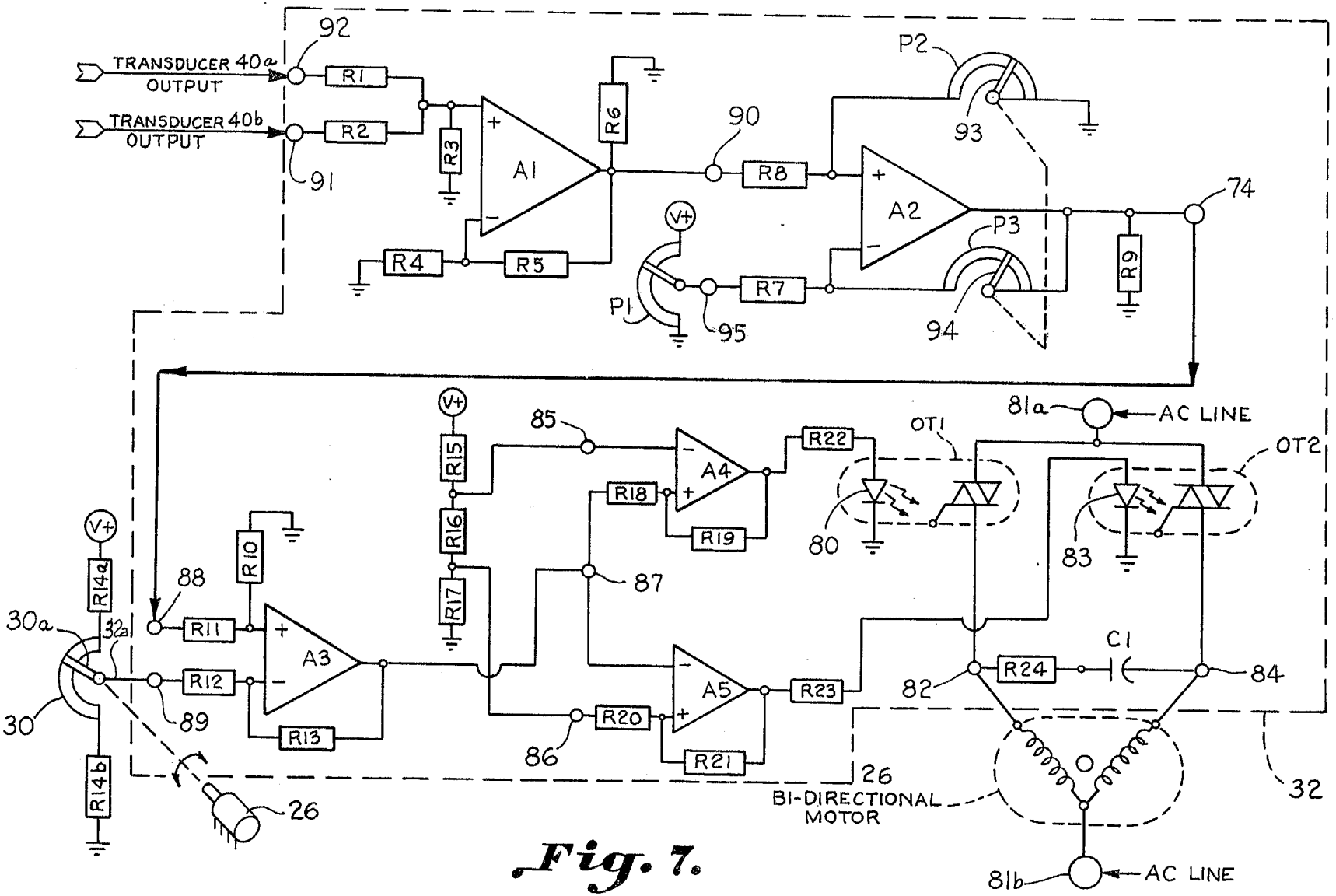
FIG. 7 is a schematic circuit diagram of a suitable electronic circuit which may be utilized with the apparatus according to the present invention.

Referring now to FIG. 7, there is shown a simplified electrical schematic for a preferred embodiment of the invention.

Amplifiers A1, A2, A3, A4 and A5 may be any suitable operational amplifiers such as described for Types LM324 in the "Linear Integrated Circuits Handbook," January, 1974 published by National Semiconductor Corporation of Santa Clara, Calif., U.S.A.

Optically coupled triacs OT1 and OT2 are electrical switching devices for alternating current (A.C.) which are well known in the art and are commercially available. As is well known, whenever light emitting diode 80 is energized, it causes OT1 to act as a closed switch and alternating current can flow between points 81*a* and 81*b* across point 82. Likewise, whenever light emitting diode 83 is energized, OT2 acts as a closed switch and A.C. current flows between points 81*a* and 81*b* across point 84. When neither light emitting diode 80 nor 83 is energized, no A.C. current flows.

Bi-directional motor 26 is a permanent magnet, A.C. snychronous, stepping motor and when connected with the phase shifting network of resistor R24 and capacitor C1 will rotate in one direction whenever the A.C. voltage is applied between points 82 and 81*b* and rotate in the opposite direction whenever the A.C. voltage is applied between points 84 and 81*b*. Such a motor and drive system is available as described for Slo-Syn motors in Catalog MD174-1 published by Superior Electric Co. of Bristol, Conn., U.S.A.

The stack of resistors R15, R16 and R17 form a voltage divider network so that the voltage at point 85 is just slightly higher than at point 86. The difference in voltages between points 85 and 86 provides a very tight dead band of operation.

Amplifier A5 along with resistors R20 and R21 forms a comparator whose characteristics is such that whenever the voltage at point 86 exceeds the voltage at point 87 amplifier A5 switches fully on supplying a voltage to current limiting resistor R23 which fires OT2, energizes point 84, and runs motor 26 in a first direction. Conversely, when the voltage at point 86 is less than at point 87, no motor drive voltage is applied to point 84.

In a similar manner, amplifier A4 along with resistors R18 and R19 forms another comparator which provides a motor drive voltage at point 82 whenever the voltage at point 87 is greater than the voltage at point 85. The motor 26 does not run when the voltage at point 87 falls within the dead band.

Amplifier A3, resistors R10, R11, R12, and R13 form a subtractor circuit whose characteristics is such that the voltage at point 87 is the difference between the voltage at points 88 and 89 and zero when point 89 exceeds 88.

Resistors R14*a*, R14*b* and the total resistance across the potentiometer 30 (used for the ratio or position transducer) also provides a voltage divider network. The position feedback voltage, appearing at point 89, is picked off of transducer 30 by the wiper 30*a* which is driven also by the motor 26. Thus, for any given programmed thickness voltage applied to point 88, the combined actions of amplifiers A3, A4 or A5 cause the drive motor 26 to drive in the appropriate direction to move the belt shifter 24 to compensate for the weight error while simultaneously driving the wiper 30*a* to track the changes in the programmed thickness voltage. The programmed thickness voltage is obtained by conditioning the output voltages from the displacement transducers 40*a* and 40*b* via amplifiers A1 and A2.

The preferred displacement transducers are linear variable differential transformers (LVDT's) which are capable of producing a direct current (D.C.) voltage output which is extremely linear with displacement such as disclosed in "Schaevitz Handbook of Measurement and Control," published by Schaevitz Engineering Company of Pennsauken, N.J., U.S.A.

Operational amplifier A1 along with resistors R1, R2, R3, R4 and R5 is configured as a D.C. voltage summer and the voltage at point 90 is equal to twice the average of the voltages applied at points 91 and 92; provided resistors R1 through R5 are equal in resistance (applicable where two transducers 40 are utilized, one under each bearing 36 and 38).

Operational amplifier A2, resistors R7 and R8, and potentiometers P2 and P3 (whose wipers 93 and 94 are ganged to rotate together) is configured as a summer/-subtractor with gain circuit or difference amplifier. If the resistance of R7 and R8 are equal and the resistances of P2 and P3 are equal, then the programmed thickness voltage at point 88 is equal to the voltage at point 90 minus the voltage at point 95 multiplied times the ratio of the resistance of potentiometer P2 to the resistance of R8. Potentiometer P1 is arranged as a voltage divider so that any desired biasing voltage can be applied to point 95.

Thus by manipulating potentiometers P1, P2 and P3 it is possible to vary both the gain and bias values of the programmable controller so that the programmed thickness voltage varies in perfect relation to feedback transducer voltage so that the amount of system speed correction perfectly matches the displacement characteristics of the fibers being processed and the sensing roll's biasing force effects thereon.

Figure 8:
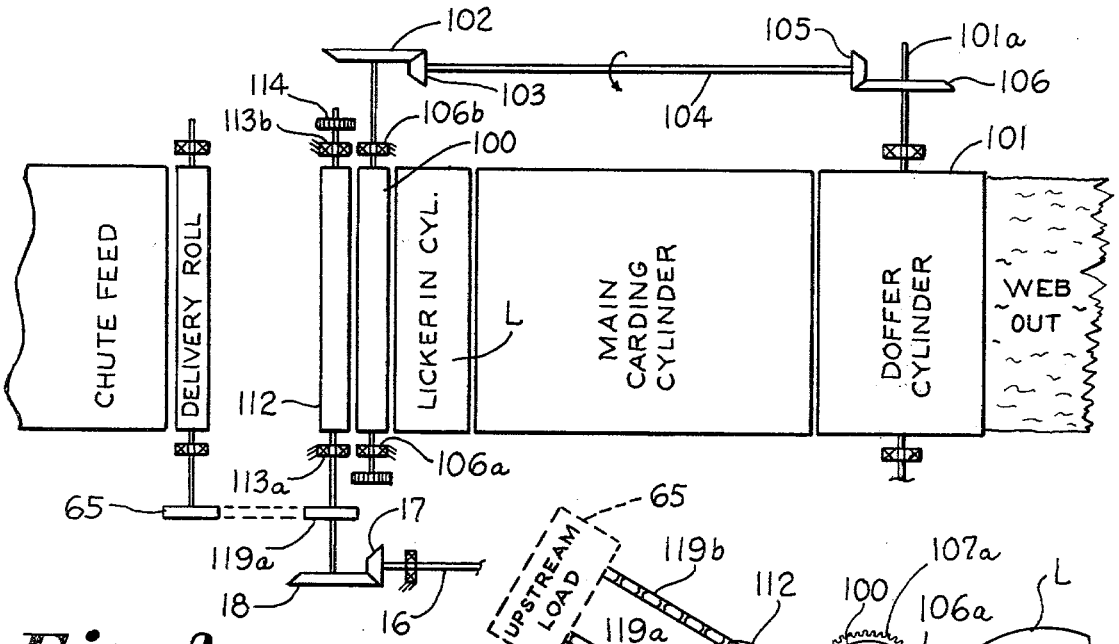
FIG. 8 is a schematic plan view of an alternate embodiment of control and sensing apparatus according to the present invention.

Referring now to FIG. 8, there is shown a plan view schematic of another embodiment of the present invention to improve the performance of conventional carding machines wherein no feed plate is utilized.

A top take-in roll 100 is driven in linear speed synchronization with the doffer cylinder 101 via a drive train comprised of bevel gears 102 and 103, drive shaft 104, bevel gear 105, and bevel gear 106 which is fixed to the shaft 101*a* of doffer 101. Top take-in roll 100 is attached to the card frame 42 by fixed bearings 106*a* and 106*b*.

On one journal of top take-in roll 100, there is affixed a spur gear 107*a* which is in driving mesh with a second spur gear 108*a* that is located directly beneath spur gear 107*a* and is affixed to the shaft or journal of a bottom take-in roll 108 so that as top take-in roll 100 is driven in one direction, bottom take-in roll 108 is driven in the opposite direction by the counter-rotation nature of meshed spur gears.

Bottom take-in roll 108 is bearingly supported by plunger 109 which is slidably mounted with respect to card frame 42 via bearing 110 and is biased against the top take-in roll 100 by a loading means schematically illustrated by a very stiff spring 111. An identical supporting and biasing system for roll 108 exists on the opposite side of the card and is not shown.

Since rolls 100 and 108 are driven directly by doffer 101 without a speed variator interposed therebetween they effectually become the output roll(s) of the control system invention.

Referring again to FIG. 9, a top feed (or input) roll 112 is mounted to the card frame 42 via fixed bearings 113*a* and 113*b*. Affixed to one shaft journal of top input roll 112 is a spur gear 114 which is in mesh with a spur gear (not shown) which is affixed to one journal of the bottom input roll 115 directly beneath roll 112 so that both rolls are driven in a counter-rotational direction in a manner illustrated for rolls 100 and 108.

Bottom input roll 115 is bearingly supported by plunger 116 which is slidably mounted to card frame 42 via bearing 117 and biased against top input roll 115 by a loading means schematically illustrated by a spring 118. An identical supporting and biasing system for roll 115 exists on the opposite side of the card and is not shown.

Driving power for upstream load 65 is typlified by sprocket 119*a* and chain 119*b*.

Figure 9:
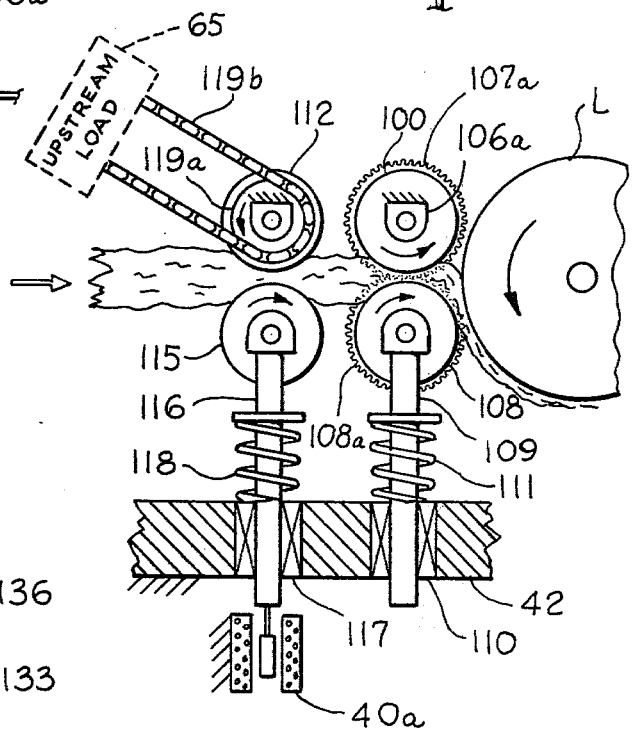
FIG. 9 is a simplified schematic elevational view of an alternate arrangement of displacement transducer apparatus and take-in rolls constructed in accordance with the present invention for use in controlling the production of a carding machine.

Referring alternately between FIGS. 8 and 9, it can now be seen that corrective speed control of the pair of input rolls 112 and 115 is accomplished by programmable controller 32 in an identical manner as described supra for the preferred embodiment.

The reaction forces resulting from the driving loads of the pair of input rolls 112 and 115 and the upstream load are all referenced directly to the card frame 42 via the fixed bearings 113*a* and 113*b* and thus do not interfere with the force balance system of the fibers compressed in the nip between the floating input roll 115 and the fixed input roll 112 which is the heart of the sensing and control system.

Further, it can be seen that the burden of restraining the batt B against the tearing action of the conventional licker-in L has been transferred to the nip of the take-in rolls 100 and 108. Since the take-in rolls are not used for displacement measurement, the biasing load provided by the spring(s) 111 can be made quite large. This enables the take-in rolls 100 and 108 to have increased holding power. This embodiment is especially suited for batts of long or highly crimped, stringy, tenacious fibers. To increase the restraining potential of the take-in rolls 100 and 108 against jerk-ins, they may be either wrapped with saw tooth wire or have extra deep flutings cut into their surfaces.

Since the sensing input rolls 12 and 15 have no restraining responsibility, their surfaces can be made smooth, if desired, and the biasing load caused by spring(s) 118 can be made relatively low. These possibilities provide the highly desirable features of less unwanted force reactions occurring in the plane of sensing (vertical through the axis of rolls 112 and 115 when arranged as shown in FIG. 9) due to the lower torsional force needed to rotate roll 115. Also, rolls 112 and 115 may be driven at a higher surface speed than rolls 100 and 108 with less possibility of extruding fibers through the operating clearances between rolls 100 and 112 and between rolls 108 and 115.

Conversely, there are operating periods when the surface speed of rolls 100 and 108 must be higher than rolls 112 and 115. Therefore, the distance between the two nips of the respective rolls pairs must be greater than the length of the fibers being processed to prevent fiber breakage. This may be accomplished by selecting the appropriate diameters for the rolls 100, 108, 112 and 115.

Figure 10:
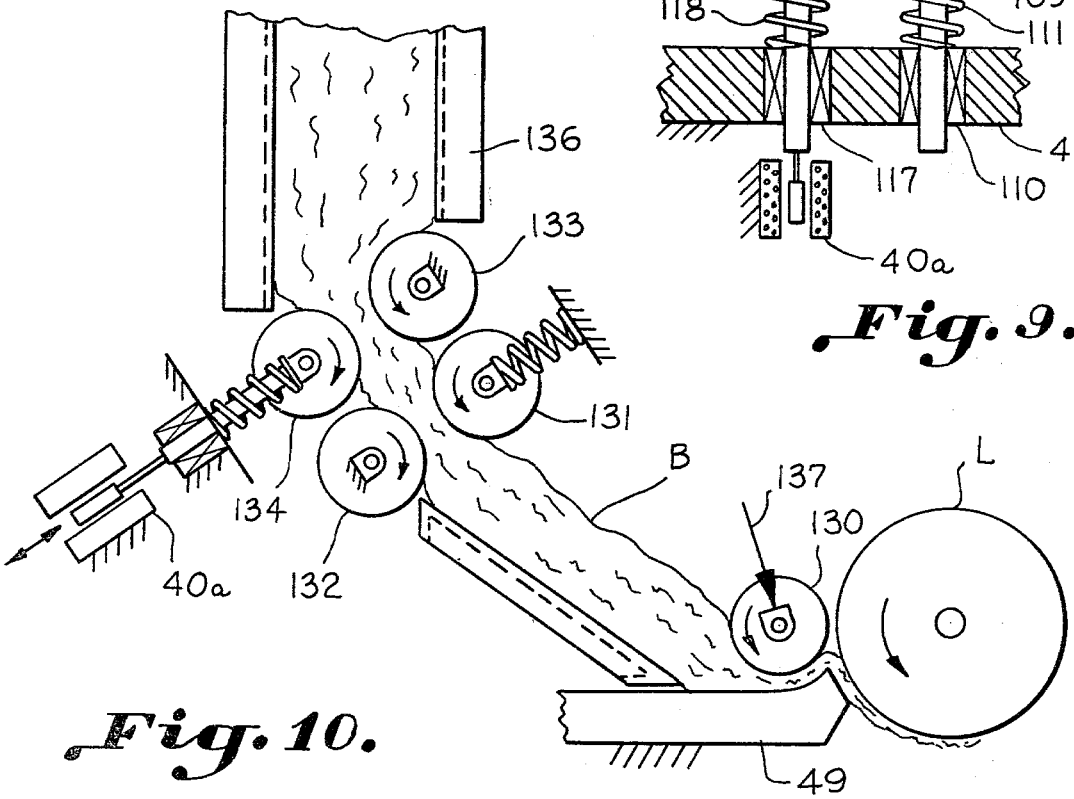
FIG. 10 is a simplified schematic elevation view illustrating an alternate embodiment of a displacement transducer and take-in roll apparatus according to the invention.

Referring now to FIG. 10, there is shown how the present invention may be used to produce an improved batt forming apparatus.

A take-in roll 130 and pair of transfer rolls 131 and 132 may be driven in linear synchronization with the doffer in a similar manner as illustrated in FIG. 3 for a prior art conventional carding machine drive. In this instance, take-in roll 130 takes the place of feed roll 10 and drive sprocket 65 (FIG. 3) would be mounted on one journal shaft of transfer roll 131. Transfer roll 132 may be counter-rotationally driven by transfer roll 131 via a pair of meshed spur gears (not shown) as described heretofore.

For best results, the mechanical drive connection between take-in roll 130 and transfer roll 131 should be selected so that the surface speed of transfer roll 131 is either equal to or slightly less than the surface speed of take-in roll 130, to provide a slight tension draft on batt B to prevent its tendency to buckle during periods that input rolls 133 and 134 run at a higher surface speed than the transfer rolls.

Input rolls 133 and 134 may be driven in basic speed synchronization with the doffer 12 but modified to compensate for the amount of fibers nipped therebetween in a similar manner as shown in FIGS. 8 and 9. In this instance, input roll 133 takes the place of input roll 112 (FIG. 9) and sensing roll 134 takes the place of sensing roll 115 (FIG. 9).

A reserve chamber 136 to receive and compact the fibers from the transport system may be any of the numerous chute feeds well known in the art.

Since the fiber restraining responsibility against the tearing action of the licker-in is carried by the take-in roll 130, a hold-down force 137 may be of the high magnitude traditionally used without adverse effect.

Finally, those skilled in the arts will recognize that if chute feed 136 is located sufficiently close to the take-in roll 130, then transfer rolls 131 and 132 may be omitted.

While a preferred embodiment of the invention has been described using specific terms, such description is for illustrative purposes only, and it is to be understood that changes and variations may be made without departing from the spirit or scope of the following claims.

What is claimed is:

1. Control apparatus for controlling the production of a web or sliver of uniform weight on a carding machine having a main driving motion, said apparatus comprising:

output roll means driven by said main driving motion;

a first nipping surface fixed against movement with respect to a frame of said carding engine;

a driven input roll providing a second nipping surface movably mounted for displacement along a line of displacement relative to said first nipping surface in response to the amount of fibrous material nipped therebetween;

means for biasing said input roll toward said first nipping surface;

transducer means including a sensing member for sensing movement generally along said line of displacement to produce a control signal which is indicative of the amount of displacement of said input roll;

speed variator means having an input driven in basic speed synchronization with said output roll and an output for driving said input roll;

a program controller responsive to said control signal from said transducer means for producing a speed control signal;

speed control means responsive to said speed control signal to alter the output speed of said speed variator means; and drive means connecting said output of said speed variator means and said driven input roll;

whereby variations in the amount of fibrous material nipped between said nipping surfaces is sensed and corrected in the same mechanical plane.

2. The apparatus of claim 1 wherein said sensing member includes a plunger mounted for linear movement along said line of displacement of said input roll.

3. Apparatus of claim 2 wherein said plunger member is mounted on said carding machine frame to engage and detect movement of a movable bearing journaled on a shaft of said input roll.

4. The apparatus of claim 3 including a feed plate carried on said carding machine providing said first nipping surface, said plunger being receivable in a bore formed in said feed plate to engage said input roll.

5. The apparatus of claim 1 wherein said drive means includes drive shaft means connected to the output of said speed variator means and intermediate drive means connected between said drive shaft means and said input roll, said intermediate drive means imparting a drive load on said input roll generally perpendicular to said line of displacement substantially eliminating measurement disturbing forces along said sensing and displacement line.

6. The apparatus of claim 1 wherein said drive means includes:

a first drive shaft connected to said speed variator output;

a second drive shaft carried generally parallel to said input roll shaft adapted to be driven by said first drive shaft;

intermediate drive means connected between said second drive shaft and said input roll drive shaft;

said intermediate drive means imparting a torsional drive load on said input roll generally perpendicular to said line of displacement substantially eliminating the transmission of measurement disturbing forces along said sensing and displacement line.

7. The apparatus of claim 1 wherein said first nipping surface includes a feed plate of said carding machine.

8. The apparatus of claim 1 wherein said first nipping surface includes a second driven input roll directly aligned and opposed with said first input roll between which said fibrous material is nipped.

9. The apparatus of claim 8 wherein said second input roll is driven in counter rotation to said first input roll.

10. The apparatus of claim 8 wherein said output roll means includes a pair of aligned directly opposed take-in rolls driven in counter rotation carried by said carding machine adjacent said first and second input rolls between which said fibrous material is fed for fiber separation to said carding machine.

11. The apparatus of claim 10 wherein said take-in rolls are heavily biased for holding on to said fibers for separation and elimination of jerk-ins when fed to said carding machine so that said movable input roll may be lightly biased to sensitively sense the thickness of said fibrous material.

12. The apparatus of claim 1 including a take-in roll carried between said input roll and said carding machine driven in synchronization with said output roll means.

13. The apparatus of claim 1 wherein said transducer sensing member includes said movable input roll.

14. Control apparatus for controlling the production of a web or sliver of uniform weight on a carding machine having a main carding drive motion, said apparatus comprising:

a stationary feed means providing a first nipping surface carried by said carding machine;

a movable driven input roll carried by said carding machine in direct opposing alignment with said first nipping surface providing a second nipping surface;

means for delivering a mass of fibrous material to said input roll to be nipped between said first and second nipping surfaces;

a driven fiber take-in roll carried adjacent said input roll and driven in sychronization by said main carding motion for feeding said fibrous mass to said carding machine for fiber separation;

said movable input roll movably mounted for displacement along a line of displacement relative to said first nipping surface in response to the amount of fibrous material nipped therebetween;

means for lightly biasing said movable input roll toward said first nipping surface;

said take-in roll being heavily biased against said fibrous material for holding on to said fibrous material fed to said carding machine for enhanced fiber separation whereby said input roll may be more lightly biased for sensitively detecting the amount of fibrous material nipped therebetween in the plane of sensing;

speed variator means having an input driven in basic speed synchronization with said take-in roll and an output drive for driving said input roll; and means responsive to the displacement of said movable input roll to modify said output drive of said speed variator means;

whereby variations in the amount of fibrous material nipped between said input nipping surfaces is sensed and corrected in the same mechanical plane.

15. The apparatus of claim 14 wherein said feed means includes a second driven input roll fixed relative to said carding machine frame in direct opposing alignment with said movable input roll.

16. The apparatus of claim 15 including a second take-in roll carried by said carding machine frame in direct opposing alignment with said first mentioned take-in roll providing opposed nipping surfaces between which said fibrous material is tightly held and fed for enhanced fiber separation.

17. The apparatus in claim 16 wherein the distance between the nips of said input rolls and said take-in rolls is greater than the length of fibers being carded.

18. The apparatus in claim 14 wherein the distance between the centerlines of said input roll and said take-in roll is greater than the length of the fibers being carded.

19. The apparatus of claim 1 wherein said biasing means applies a distributed load which is greater than two pounds per inch of batt width but less than 100 pounds per inch of batt width when processing batts with a nominal weight of less than fifty ounces per square yard.

20. The apparatus of claim 1 wherein said biasing means applies a distributed load which is greater than 10 pounds per inch of batt width but less than 400 pounds per inch of batt width when processing batts with a nominal weight greater than 50 ounces per square yard but less than 100 ounces per square yard.

21. The apparatus of claim 1 wherein said speed variator means includes a mechanical variable speed transmission with its output speed adjustable by either an electric or fluid driven motor whereby mechanical work to alter the speed of the system is taken from an external source rather than diminishing the potential energy level of the compressed fibers being measured, thereby increasing both the sensitivity and the rate of response of the system.

22. The apparatus of claim 14 wherein said speed variator means includes a mechanical variable speed transmission with its output speed adjustable by either an electric or fluid driven motor.

* * * * *